US009428937B2

(12) United States Patent
Tagtow et al.

(10) Patent No.: US 9,428,937 B2
(45) Date of Patent: Aug. 30, 2016

(54) MULTI-POINT LOCK HAVING SEQUENTIALLY-ACTUATED LOCKING ELEMENTS

(75) Inventors: Gary E. Tagtow, Sioux Falls, SD (US); Tracy Lammers, Sioux Falls, SD (US); Allen Rickenbaugh, Sioux Falls, SD (US); Eric J. Adamson, Tea, SD (US); Austin Hemmingsen, Sioux Falls, SD (US); Dan Raap, Hartford, SD (US)

(73) Assignee: Amesbury Group, Inc., Amesbury, MA (US)

( * ) Notice: Subject to any disclaimer, the term of this patent is extended or adjusted under 35 U.S.C. 154(b) by 490 days.

(21) Appl. No.: 13/189,305

(22) Filed: Jul. 22, 2011

(65) Prior Publication Data

US 2013/0019643 A1 Jan. 24, 2013

(51) Int. Cl.

| | |
|---|---|
| ***E05B 59/00*** | (2006.01) |
| ***E05B 63/14*** | (2006.01) |
| ***E05B 17/20*** | (2006.01) |
| ***E05C 9/04*** | (2006.01) |

(Continued)

(52) U.S. Cl.

CPC ..... *E05B 17/2034* (2013.01); *E05C 9/047* (2013.01); *E05B 63/143* (2013.01); *E05B 63/18* (2013.01); *E05B 2015/0493* (2013.01); *Y10T 70/523* (2015.04); *Y10T 70/5226* (2015.04); *Y10T 70/7582* (2015.04)

(58) Field of Classification Search

CPC .... E05B 59/00; E05B 17/20; E05B 17/2007; E05B 17/2034; E05B 17/2042; E05B 17/208; E05B 55/00; E05B 63/18; E05B 63/143; E05B 2015/0493; E05C 9/00; E05C 9/026; E05C 9/04; E05C 9/047; E05C 9/02; E05C 9/06; E05C 9/002; Y10T 70/5226; Y10T 70/5235; Y10T 70/5239; Y10T 70/55; Y10T 70/7582; Y10T 70/523

USPC ..... 70/107–111, DIG. 6; 292/32–36

See application file for complete search history.

(56) References Cited

U.S. PATENT DOCUMENTS

| | | | | |
|---|---|---|---|---|
| 419,384 | A * | 1/1890 | Towne | 70/110 |
| 651,947 | A * | 6/1900 | Johnson | 70/110 |

(Continued)

FOREIGN PATENT DOCUMENTS

| | | |
|---|---|---|
| AT | 84928 | * 12/1920 |
| DE | 1002656 | 2/1957 |

(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.

(Continued)

*Primary Examiner* — Lloyd Gall

(57) ABSTRACT

A lock includes a deadbolt assembly having a deadbolt and a deadbolt actuator. The lock also includes a latch assembly discrete from the deadbolt assembly. The latch assembly includes a shoot bolt and a shoot bolt actuator. A blocking element may block actuation of the shoot bolt from an unlocked position to a locked position when the deadbolt is in a retracted position. Alternatively or additionally, the blocking element may block actuation of the shoot bolt from a locked position to an unlocked position when the deadbolt is in an extended position.

15 Claims, 10 Drawing Sheets

(51) Int. Cl.
*E05B 63/18* (2006.01)
*E05B 15/04* (2006.01)

(56) References Cited

U.S. PATENT DOCUMENTS 738,280 A * 9/1903 Bell et al. ..... 70/108
972,769 A 10/1910 Lark
1,094,143 A 4/1914 Hagstrom
1,142,463 A 6/1915 Sheperd
1,251,467 A 1/1918 Blixt et al.
1,277,174 A * 8/1918 Bakst ..... 70/108
1,359,347 A 11/1920 Fleisher
1,366,909 A 2/1921 Frommer
1,596,992 A * 8/1926 Ognowicz ..... 70/109
1,646,674 A * 10/1927 Angelillo ..... 70/109
1,666,654 A 4/1928 Hiering
1,716,113 A 6/1929 Carlson
2,535,947 A 12/1950 Newell
2,739,002 A 3/1956 Johnson
2,862,750 A 12/1958 Minke
3,064,462 A 11/1962 Ng et al.
3,162,472 A 12/1964 Rust
3,250,100 A 5/1966 Cornaro
3,332,182 A 7/1967 Mark
3,413,025 A 11/1968 Sperry
3,437,364 A 4/1969 Walters
RE26,677 E 10/1969 Russell et al.
3,586,360 A 6/1971 Perrotta
3,806,171 A 4/1974 Fernandez
3,899,201 A 8/1975 Paioletti
3,904,229 A 9/1975 Waldo
3,953,061 A 4/1976 Hansen et al.
4,076,289 A 2/1978 Fellows et al.
4,116,479 A 9/1978 Poe
4,132,438 A 1/1979 Guymer
4,236,396 A 12/1980 Surko et al.
4,288,944 A 9/1981 Donovan
4,476,700 A 10/1984 King
4,500,122 A 2/1985 Douglas
4,593,542 A 6/1986 Rotondi et al.
4,602,812 A 7/1986 Bourne
4,607,510 A 8/1986 Shanaan et al.
4,643,005 A 2/1987 Logas
4,691,543 A 9/1987 Watts
4,754,624 A 7/1988 Fleming et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson et al.
5,077,992 A 1/1992 Su
5,092,144 A 3/1992 Fleming et al.
5,118,151 A 6/1992 Nicholas, Jr. et al.
5,125,703 A 6/1992 Clancy et al.
5,171,050 A 12/1992 Mascotte
5,172,944 A 12/1992 Munich et al.
5,197,771 A 3/1993 Kaup et al.
5,265,452 A 11/1993 Dawson et al.
5,290,077 A 3/1994 Fleming
5,373,716 A 12/1994 MacNeil et al.
5,382,060 A 1/1995 O'Toole et al.
5,388,875 A 2/1995 Fleming
5,404,737 A 4/1995 Hotzl
5,482,334 A 1/1996 Hotzl
5,495,731 A 3/1996 Riznik
5,513,505 A 5/1996 Dancs
5,516,160 A 5/1996 Kajuch
5,524,941 A 6/1996 Fleming
5,524,942 A 6/1996 Fleming
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.
5,782,114 A * 7/1998 Zeus et al. ..... 70/109
5,791,700 A 8/1998 Biro
5,820,170 A 10/1998 Clancy
5,820,173 A 10/1998 Fuller
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,915,764 A 6/1999 MacDonald
5,951,068 A 9/1999 Strong et al.
6,050,115 A 4/2000 Schroter et al.
6,094,869 A 8/2000 Magoon et al.
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 * 7/2001 von Resch et al. ..... 70/107
6,282,929 B1 9/2001 Eller et al.
6,283,516 B1 9/2001 Viney
6,293,598 B1 9/2001 Rusiana
6,327,881 B1 * 12/2001 Grundler et al. ..... 70/107
6,389,855 B2 * 5/2002 Renz et al. ..... 70/107
6,443,506 B1 9/2002 Su
6,454,322 B1 9/2002 Su
6,502,435 B2 1/2003 Watts et al.
6,516,641 B1 2/2003 Segawa
6,637,784 B1 10/2003 Hauber et al.
6,672,632 B1 1/2004 Speed et al.
6,688,656 B1 * 2/2004 Becken ..... 292/26
6,733,051 B1 5/2004 Cowper
6,776,441 B2 8/2004 Liu
6,810,699 B2 11/2004 Nagy
6,871,451 B2 3/2005 Harger et al.
6,935,662 B1 8/2005 Hauber et al.
6,971,686 B2 12/2005 Becken
6,994,383 B2 2/2006 Morris
7,025,394 B1 4/2006 Hunt
7,083,206 B1 * 8/2006 Johnson ..... 292/332
7,155,946 B2 * 1/2007 Lee et al. ..... 70/107
7,207,199 B2 * 4/2007 Smith et al. ..... 70/134
7,249,791 B2 * 7/2007 Johnson ..... 292/333
7,261,330 B1 8/2007 Hauber
7,404,306 B2 7/2008 Walls et al.
7,418,845 B2 9/2008 Timothy
7,513,540 B2 4/2009 Hagemeyer et al.
7,634,928 B2 12/2009 Hunt
7,677,067 B2 3/2010 Riznik et al.
7,707,862 B2 5/2010 Walls et al.
7,726,705 B2 6/2010 Kim
7,735,882 B2 6/2010 Abdollahzadeh et al.
7,856,856 B2 12/2010 Shvartz
7,878,034 B2 2/2011 Alber et al.
8,182,002 B2 5/2012 Fleming
8,348,308 B2 1/2013 Hagemeyer et al.
8,376,414 B2 2/2013 Nakanishi et al.
8,398,126 B2 3/2013 Nakanishi et al.
8,840,153 B2 9/2014 Juha
8,850,744 B2 10/2014 Bauman et al.
2002/0104339 A1 8/2002 Saner
2003/0159478 A1 8/2003 Nagy
2004/0107746 A1 6/2004 Chang
2004/0239121 A1 12/2004 Morris
2005/0103066 A1 5/2005 Botha et al.
2005/0144848 A1 7/2005 Harger et al.
2007/0068205 A1 3/2007 Timothy
2007/0080541 A1 4/2007 Fleming
2007/0113603 A1 5/2007 Polster
2007/0170725 A1 7/2007 Speyer et al.
2008/0087052 A1 4/2008 Abdollahzadeh et al.
2008/0092606 A1 4/2008 Meekma
2008/0141740 A1 6/2008 Shvartz
2008/0150300 A1 6/2008 Harger et al.

(56) References Cited

U.S. PATENT DOCUMENTS

| | | | |
|---|---|---|---|
| 2008/0156048 | A1 | 7/2008 | Topfer |
| 2008/0156049 | A1 | 7/2008 | Topfer |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2009/0078011 | A1 | 3/2009 | Avni |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2011/0198867 | A1 | 8/2011 | Hagemeyer et al. |
| 2011/0289987 | A1 | 12/2011 | Chiou et al. |
| 2012/0146346 | A1 | 6/2012 | Hagemeyer et al. |
| 2012/0306220 | A1 | 12/2012 | Hagemeyer et al. |
| 2013/0140833 | A1 | 6/2013 | Hagemeyer et al. |
| 2013/0152647 | A1 | 6/2013 | Terei et al. |
| 2013/0234449 | A1 | 9/2013 | Dery et al. |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |

FOREIGN PATENT DOCUMENTS

| | | | |
|---|---|---|---|
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | A1 | 2/1993 |
| DE | 29807860 | | 8/1998 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 231173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2581531 | A1 | 4/2013 |
| EP | 2584123 | A1 | 4/2013 |
| EP | 2584124 | A2 | 4/2013 |
| FR | 1142316 | | 3/1957 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| GB | 226170 | | 4/1925 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | A | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196 375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | A | 3/1994 |
| GB | 2280474 | | 2/1995 |
| GB | 2364545 | A | 1/2002 |
| GB | 2496911 | A | 5/2013 |
| IT | 614960 | | 1/1961 |
| SE | 309372 | | 3/1969 |
| WO | WO 96/25576 | | 8/1996 |
| WO | 02/33202 | | 4/2002 |
| WO | WO 2007104499 | A2 | 9/2007 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

PCT International Search Report and Written Opinion in Application PCT/US2012/047035, mailed Nov. 28, 2012, 12 pgs.

* cited by examiner

MULTI-POINT LOCK HAVING SEQUENTIALLY-ACTUATED LOCKING ELEMENTS

Most consumers are familiar with the operation of common single- and two-bore entry door locks that have a handle for the latch and a thumbturn/key cylinder for a deadbolt located directly above the handle. The lock systems used for patio doors, however, can be very different from entry door locks. Patio systems often have a means of locking the door that may be actuated by a handle, actuated by a thumbturn, or may require actuation by a combination of both the handle and the thumbturn. To offer a higher level of security, many patio doors offer multi-point locks with gearboxes to operate the various lock members. For operators not familiar with these types of locks, however, confusion may result with regards to operation. For example, the thumbturn or key cylinder may be located below rather than above the handle. Also, the methods of actuating the various locking members in a multi-point lock system are significantly different than the common two-bore door locks that consumers are most familiar with. When a consumer is not familiar with a multi-point lock system, they may harbor a misconception that the door is locked when the thumbturn is rotated, as is often the case with a typical entry door deadbolt. However, simply turning the thumbturn in many gearbox systems only arms the lock, but leaves the door in an unsecured state. Thus, without specific familiarity, an operator may leave the door unsecured even though they think the door has been locked. This risk is especially high for visitors to a residence or business, such as a babysitter or other caretaker.

SUMMARY

In the multi-point lock described herein, a thumbturn/key cylinder is located above a handle, similar to common two-bore entry door locks. The deadbolt may be extended into the locked position by rotating the thumbturn/key cylinder, which places the door into an acceptable minimum level of security, as expected by a consumer that is familiar with standard entry door locks. The additional operation of rotating the handle in an upward direction will add the multi-point level of security, but is not required to achieve a reasonable level of security for the door. The additional locking elements, referred to herein with regard to a particular embodiment as "shoot bolts," are prevented from being extended unless the deadbolt is first extended. Since the deadbolt is very visible when, it limits the likelihood of attempting to close the door with the shoot bolts extended, which would damage the door frame. This functionality is similar to that of the common two-bore lock system and is very intuitive to the typical consumer.

Because discrete deadbolt and latch housings are utilized, the deadbolt and latch assemblies contained therein can be greatly simplified. Also, discrete housings allow the lock described herein to be used on doors having both standard and non-standard spacing configurations between the thumbturn and the handle. For example, typical multi-point gearbox locks have a center-to-center (thumbturn to handle) distance of about 3.62 inches. The technology depicted herein allows for spacing up to and greater than about 5.5 inches. In other words, the discrete housing described herein may be installed anywhere along a lock face plate, as required or desired for a particular application. Increasing the distance between the handle and thumbturn may create a stronger locking force.

In one aspect, the technology relates to a lock including: a deadbolt assembly having a deadbolt and a deadbolt actuator; a latch assembly discrete from the deadbolt assembly, the latch assembly including a shoot bolt and a shoot bolt actuator; and a blocking element for blocking at least one of (a) actuation of the shoot bolt from an unlocked position to a locked position when the deadbolt is in a retracted position, and (b) actuation of the shoot bolt from a locked position to an unlocked position when the deadbolt is in an extended position. In an embodiment, the blocking element is a pawl, wherein when the deadbolt is in the retracted position, the pawl is in a blocking position that prevents movement of the shoot bolt from the unlocked position to the locked position, or prevents movement of the shoot bolt from the locked position to the unlocked position. In another embodiment, the deadbolt assembly includes a drive element engaged with the deadbolt and the pawl, wherein an extending movement of the deadbolt from the retracted position to the extended position causes a corresponding first movement of the drive element from a first position to a second position, such that the drive element moves the pawl from a blocking position to an unblocking position.

In another embodiment of the above aspect, the deadbolt assembly includes a drive element engaged with the deadbolt and the pawl, wherein a retracting movement of the deadbolt from the extended position to the refracted position causes a corresponding movement of the drive element from a second position to a first position, such that the drive element moves the pawl from a blocking position to an unblocking position. In yet another embodiment, the lock includes a spring element for biasing the pawl into the blocking position. In still another embodiment, the deadbolt actuator is adapted to engage with a thumbturn external to the deadbolt assembly and the shoot bolt actuator is adapted to engage with a handle external to the latch assembly. In another embodiment, the deadbolt assembly includes a deadbolt housing and the latch assembly includes a latch housing discrete from the deadbolt housing. In still another embodiment, the lock includes a face plate, wherein the deadbolt housing is secured to the face plate at the first location and wherein the latch housing is secured to the face plate at a second location.

In another aspect, the technology relates to a lock including: a deadbolt housing; a deadbolt located within the deadbolt housing; a deadbolt actuator for actuating the deadbolt; a shoot bolt selectively moveable between a locked position and an unlocked position, wherein the shoot bolt is actuated remote from the deadbolt housing; and a pawl located in the deadbolt housing, wherein the pawl blocks movement of the shoot bolt from at least one of (a) the unlocked position to the locked position, and (b) the locked position to the unlocked position. In an embodiment, the lock includes: a latch housing discrete from the deadbolt housing; and a latch assembly located within the latch housing, the latch assembly including a shoot bolt actuator for moving the shoot bolt from the unlocked position to the locked position. In other embodiments, the lock further includes a thumb turn for actuating the deadbolt actuator and/or a handle for actuating the shoot bolt actuator. In another embodiment, the lock includes a pawl bias element for biasing the pawl into a blocking position. In yet another embodiment, the lock incldues a deadbolt bias element for biasing the deadbolt into at least one of an extended position and a retracted position. In still another embodiment, the lock includes a deadbolt bias element for biasing the deadbolt into both of an extended position and a retracted position.

In another aspect, the technology relates to a method of actuating a multi-point lock, the method including: extending a first locking element using a first actuation element; and thereafter, extending a second locking element using a second actuation element, wherein the second locking element is extendable only by first extending the first locking element. In an embodiment, the method includes: retracting the first locking element using the first actuation element; and thereafter, retracting the second locking element using the second actuation element, wherein the second locking element is retractable only by first retracting the first locking element. In another embodiment, extending the first locking element removes a blocking element from a path of travel of the second locking element.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
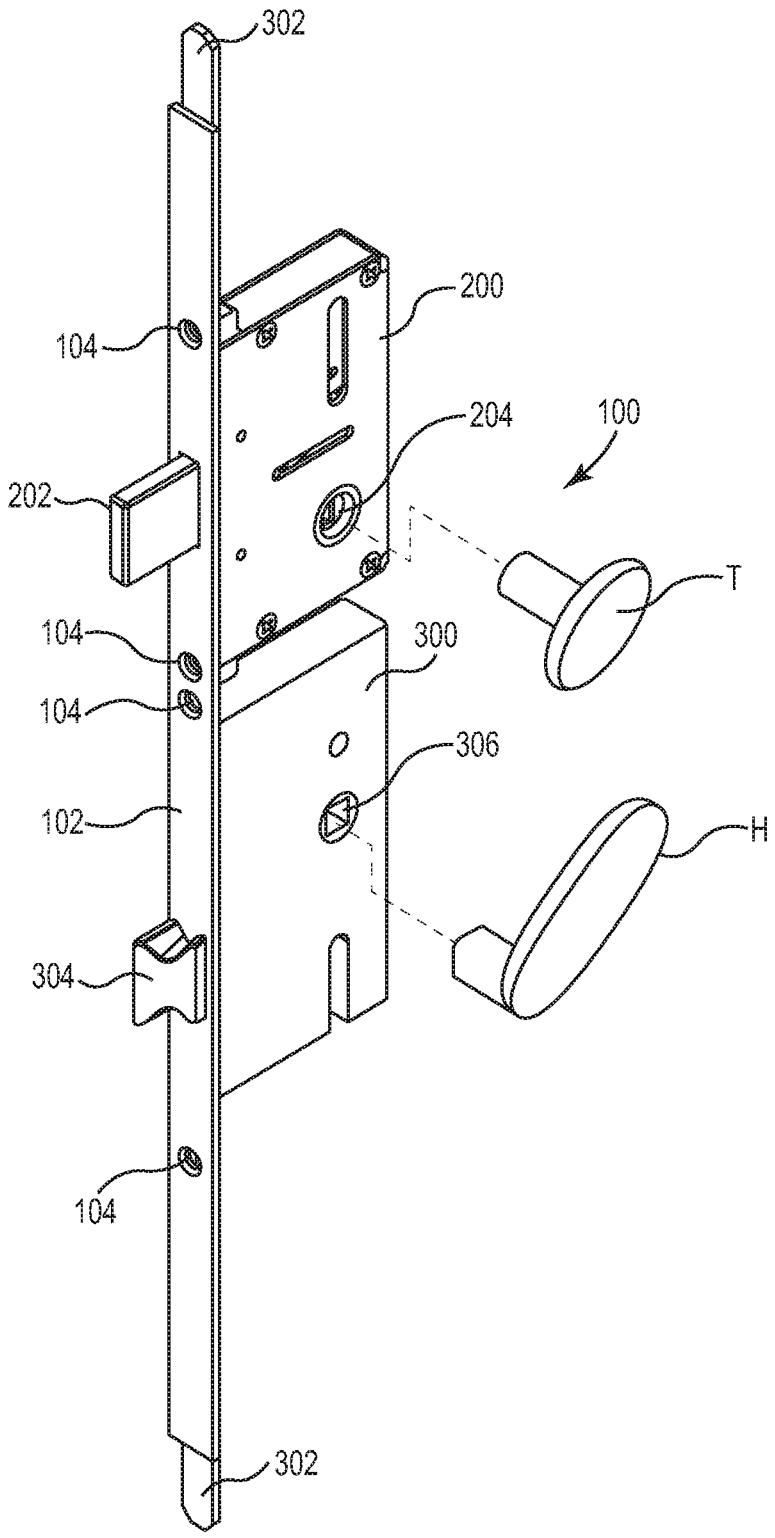
FIG. 1 is a perspective view of a multi-point lock.

FIG. 1 depicts a perspective view of a multi-point lock (MPL) 100 having a plurality of locking elements. The MPL 100 includes a face bar or face plate 102, to which is secured a deadbolt housing 200 and a latch housing 300. The housings 200, 300 are attached to the face plate 102 with one or more screws, bolts, or other fasteners 104. The face plate 102 covers an opening formed in the locking face of a door, into which the various components of the MPL 100 are installed. One or more locking elements (in the depicted embodiment, shoot bolts) 302 are actuated by a latch assembly located in the latch housing 300, so as to move between locked and unlocked positions. Additionally, a latch 304 retractably projects from the latch housing 300. The shoot bolts 302 and latch 304 may be actuated by one or more handles, thumbturns, or other devices located proximate the latch housing 300. In one embodiment, for example, a handle H is operably connected to an actuator 306 within the latch housing 300. In a desirable commercial embodiment, rotation of the handle H to retract the shoot bolts 302 would also retract the latch 304, which is typically biased into a projecting position.

Another locking element (in the depicted embodiment, a deadbolt) 202 is actuated by a deadbolt assembly in the deadbolt housing 200, so as to move between extended and retracted positions. The deadbolt 202 may be actuated by a handle, thumbturn, or other device located proximate the deadbolt housing 200. In one embodiment, for example, a thumbturn T operably connected to an actuator 204 drives the remaining elements of the deadbolt assembly to actuate the deadbolt 202. In a commercial embodiment of the MPL 100, a thumbturn T actuates the deadbolt 202 and a handle H actuates the shoot bolts 302 and latch 304. In that regard, once installed, the MPL 100 maintains the outward visual appearance of a typical entry door lock (with regard to location and spacing of the thumbturn T and handle H), but with specific, unique functionality, as described below.

Figure 2:
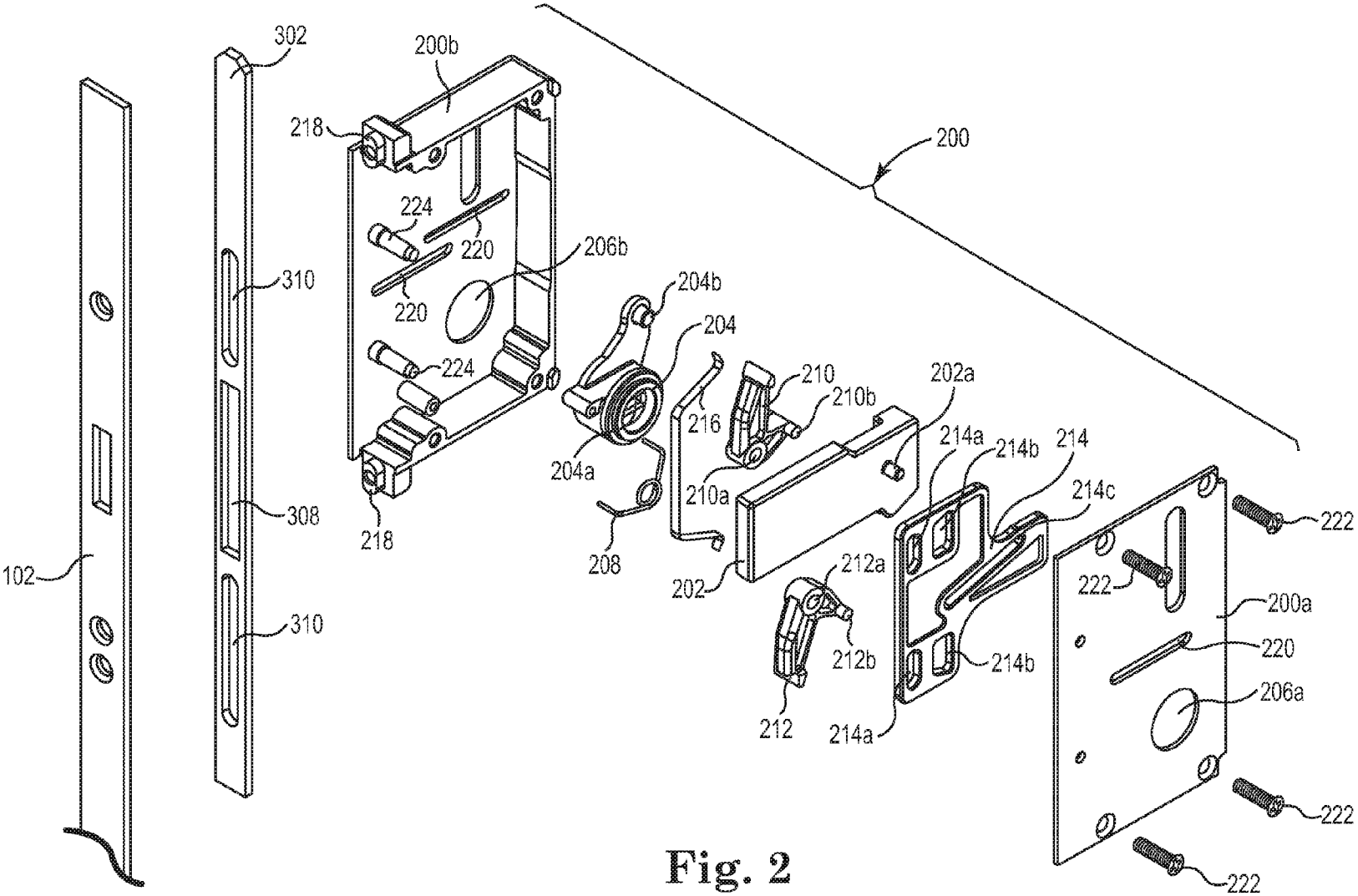
FIG. 2 is an exploded perspective view of a deadbolt assembly.

FIG. 2 depicts an exploded perspective view of the deadbolt housing 200 and components of the deadbolt assembly. The deadbolt housing 200 includes one or more housing components 200*a*, 200*b* that at least partially enclose the deadbolt assembly. The actuator 204 includes a slot 204*a* that is configured to receive a tailpiece from a thumbturn or key cylinder. In certain embodiments, a thumbturn will be located on an interior side of a door and a key cylinder on an exterior side. The actuator 204 is configured to rotate within actuator openings 206*a*, 206*b* defined by the housing components 200*a*, 200*b*. A bi-stable or over-center bias spring 208 biases the actuator 204 into both first and second positions (depicted below). The actuator 204 includes a deadbolt pin 204*b* that engages with a slot (see FIGS. 5A-5C) defined by a surface of the deadbolt 202. Two pawls 210, 212 are located above and below the deadbolt 202. Each pawl 210, 212 engages with a drive element 214. Each pawl 210, 212 includes an opening 210*a*, 212*a* that receives and pivots about a housing pin 224 that spans the housing components 200*a*, 200*b*. The housing pins 224 are sized to fit within guide slots 214*a* in the drive element 214. In an alternative embodiment, the housing pins 224 may instead be integral with each of the pawls 210, 212. Pawl actuator pins 210*b*, 212*b* located on each pawl 210, 212 engage with openings 214*b* defined by the drive element 214. A drive pin 202*a* engages with an elongate drive slot 214*c* defined by the drive element 214. As the deadbolt 202 is extended, movement of the pin 202*a* along the elongate drive slot 214*c* moves the drive element 214 from a first position to a second position, rotating the pawls 210, 212 as described below. The pawls 210, 212 are biased toward a blocking position by a pawl spring 216.

The upper shoot bolt 302 includes an elongate deadbolt opening 308 that allows for passage of the deadbolt 202 and engagement with the pawls 210, 212, as described below. One or more guide slots 310 engage one or more projections 218 located on one of the housing components 200*b*. A number of other slots 220 help ensure proper alignment of the various deadbolt assembly components during actuation of the deadbolt assembly. A number of screws, bolts, or other mechanical or chemical fasteners 222 secure the housing components 200*a*, 200*b*.

Figure 3A:
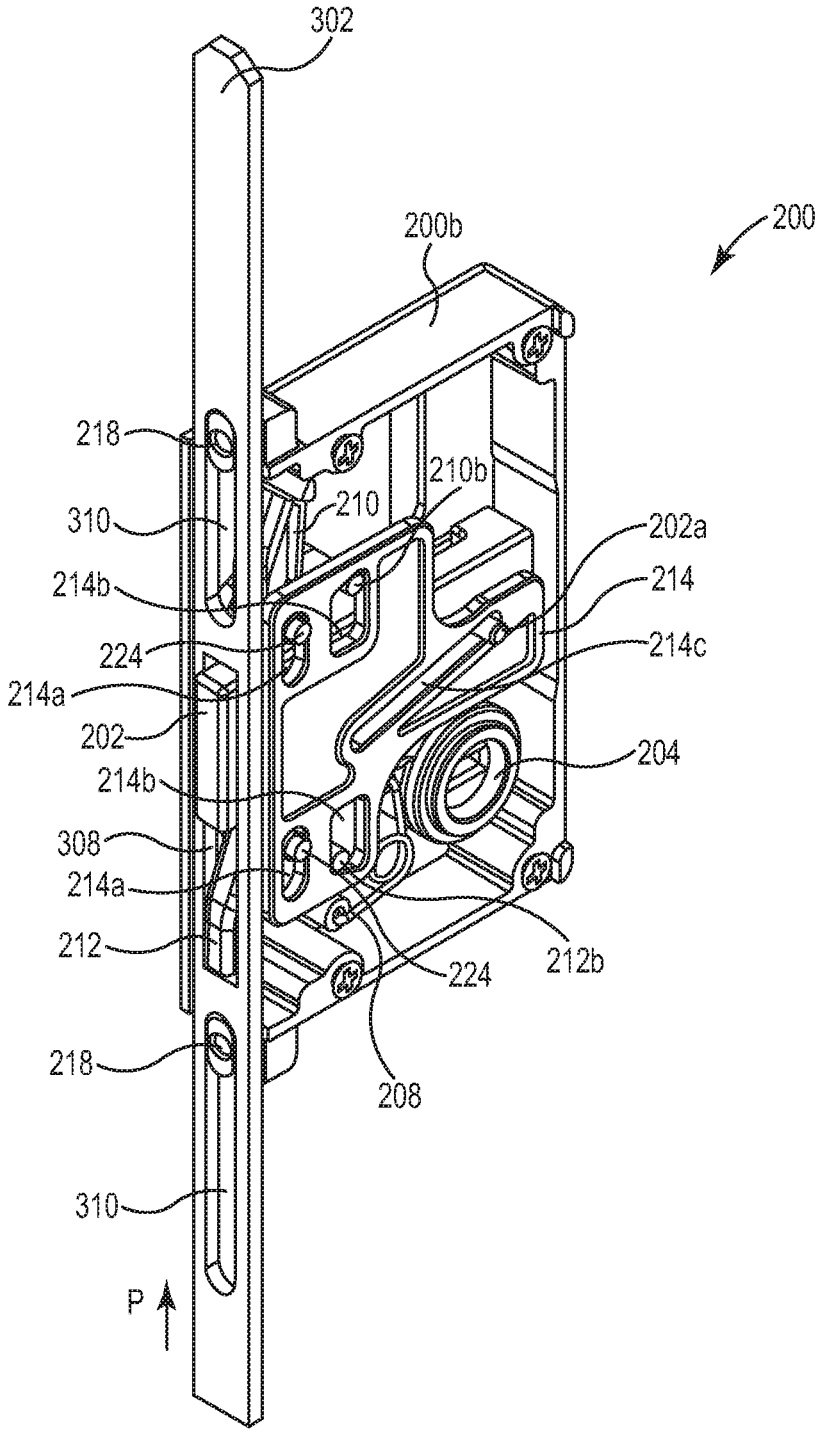
FIGS. 3A-3B are perspective and side views, respectively, of the deadbolt assembly of FIG. 2 in a retracted position, with a portion of a housing removed.
Figure 3B:
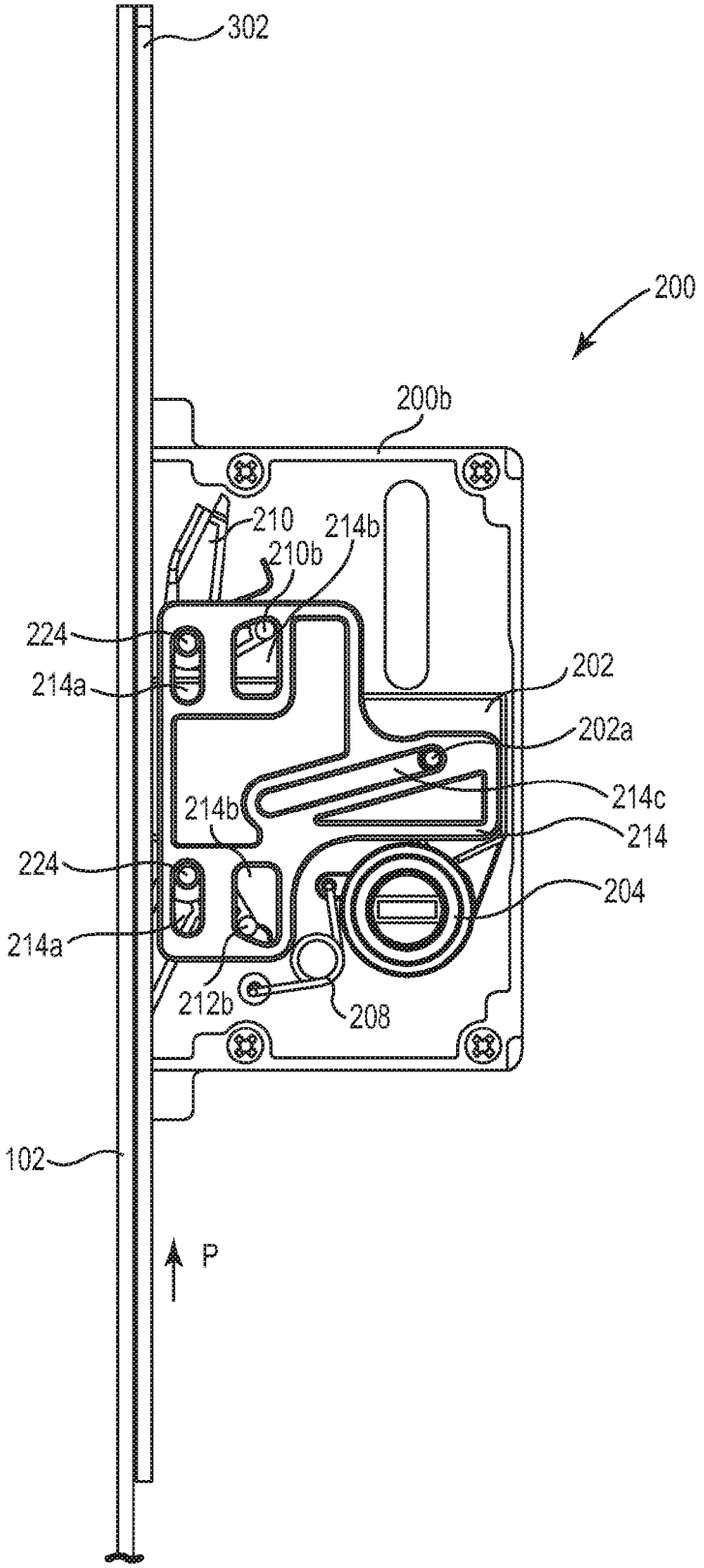

FIGS. 3A-3B are partial perspective and side views, respectively, of the deadbolt assembly 200, with the housing component 200*a* removed. Additionally, the face plate 102 is not depicted in FIG. 3A, so the interaction between the various elements may be viewed. In FIGS. 3A and 3B, the deadbolt 202 is in a retracted position, and the shoot bolt 302 is in an unlocked position. The deadbolt actuator 204 is in a first position, biased there by the bi-stable spring 208. The deadbolt pin 204*b* is engaged with the deadbolt slot (depicted in FIG. 5A), thus holding the deadbolt 202 in the retracted position. The drive pin 202*a* is located at a rear end of the elongate drive slot 214*c* in the drive element 214. The housing pins 224 are located proximate the top ends of the guide slots 214*a*. The pawl actuator pin 210*b* of the upper pawl 210 engages with a rear corner of the upper opening

214*b*, thus urging the pawl 210 into an unblocking position. Conversely, the pawl actuator pin 212*b* of the lower pawl 212 engages with a front corner of the lower opening 214*b*, thus urging the pawl 212 into a blocking position. In the blocking position, the lower pawl 212 extends into the deadbolt opening 308, into an upward path of travel P of the shoot bolt 302, thus preventing movement of the shoot bolt 302 from the unlocked position to the locked position. Additionally, in this position, the projections 218 are located proximate the tops of the guide slots 310. Thus, due to the blocking position of the lower pawl 212 against a lower end of the deadbolt opening 308, the shoot bolt 302 cannot be moved from the unlocked position to the locked position. In that regard, the lower pawl 212 acts as an anti-slam device, preventing the shoot bolt 302 from being extended until the deadbolt 202 is extended, as described below.

Figure 4A:
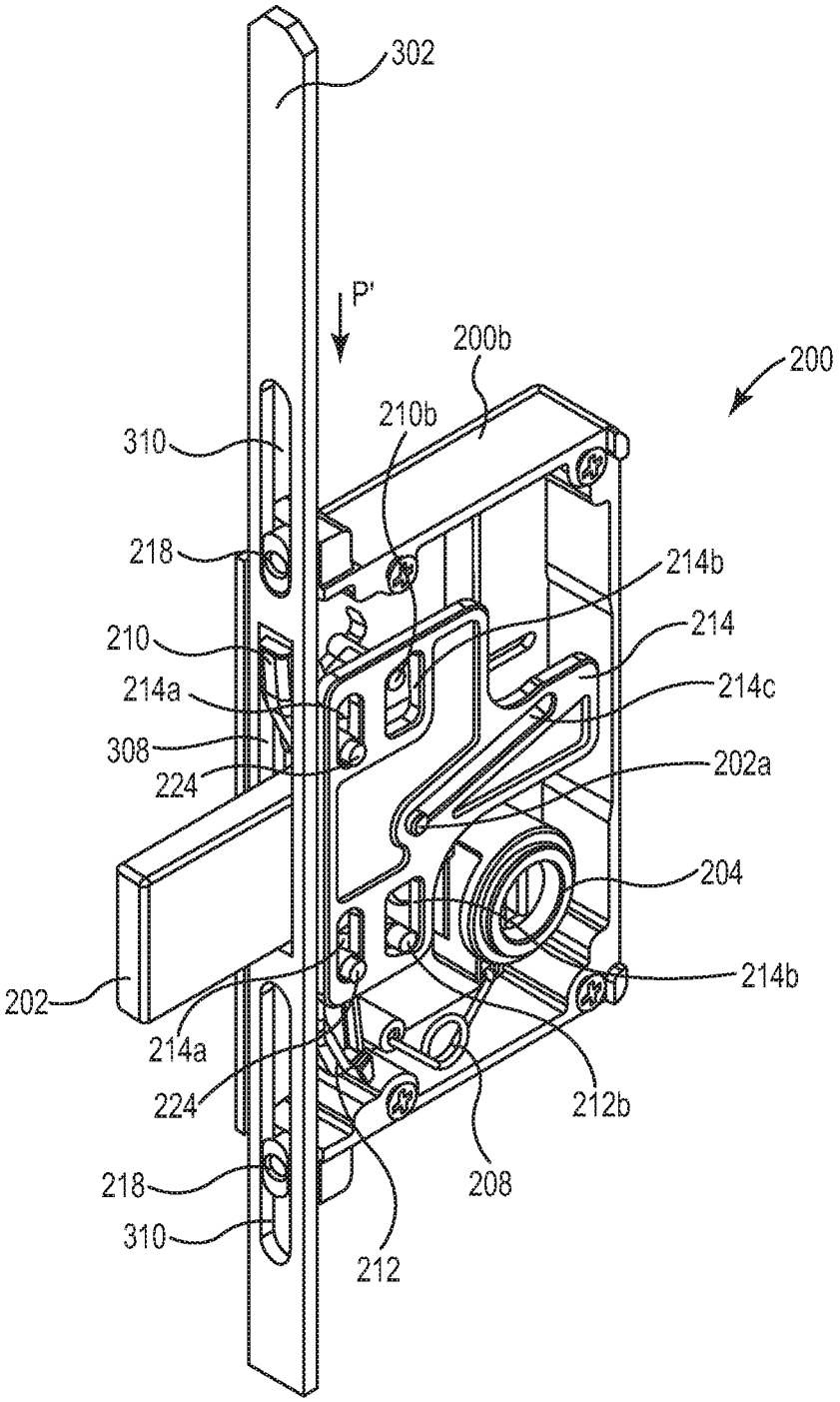
FIGS. 4A-4B are perspective and side views, respectively, of the deadbolt assembly of FIG. 2 in an extended position, with a portion of a housing removed.
Figure 4B:
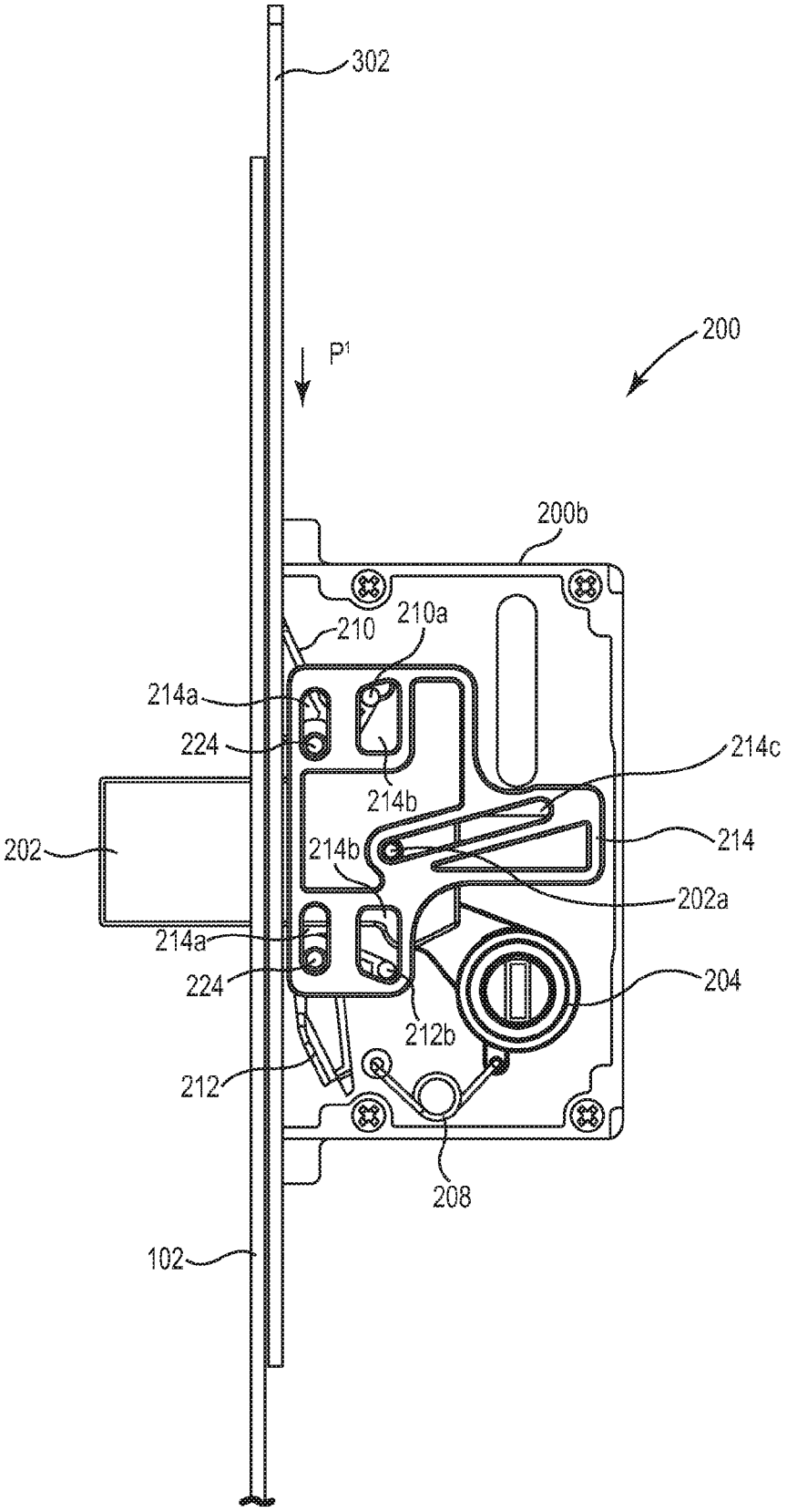

FIGS. 4A-4B are partial perspective and side views, respectively, of the deadbolt assembly 200, with the housing component 200*a* removed. Additionally, the face plate 102 is not depicted in FIG. 4A, so the interaction between the various elements may be viewed. In FIGS. 4A and 4B, the deadbolt 202 is in the extended position, and the shoot bolt 302 is in the locked position. The deadbolt actuator 204 is in a second position, again biased by the bi-stable spring 208. The deadbolt pin 204*b* is engaged with an opposite end of the deadbolt slot (depicted in FIG. 5A), thus holding the deadbolt 202 in the extended position. The drive pin 202*a* is located at a forward end of the elongate drive slot 214*c* in the drive element 214. The housing pins 224 are located proximate the bottom ends of the guide slots 214*a*. The pawl actuator pin 210*b* of the upper pawl 210 engages with a front corner of the opening 214*b*, thus urging the pawl 210 into a blocking position. Conversely, the pawl actuator pin 212*b* of the lower pawl 212 engages with a rear corner of the lower opening 214*b*, thus urging the pawl 212 into an unblocking position. In the blocking position, the upper pawl 212 extends into the deadbolt opening 308, into a downward direction of travel P' of the shoot bolt 302, thus preventing movement of the shoot bolt 302 from the locked position to the unlocked position. Additionally, in this position, the projections 218 are located proximate the bottom ends of the guide slots 310, depending on the lengths of the guide slots 310. Thus, due to the blocking position of the upper pawl 210 against an upper end of the deadbolt opening 308, the shoot bolt 302 cannot be moved from the locked position to the unlocked position. In that regard, the upper pawl 210 prevents moving the shoot bolt 302 from the locked to the unlocked position, without first retraction of the deadbolt 202, as described below.

Figure 5A:
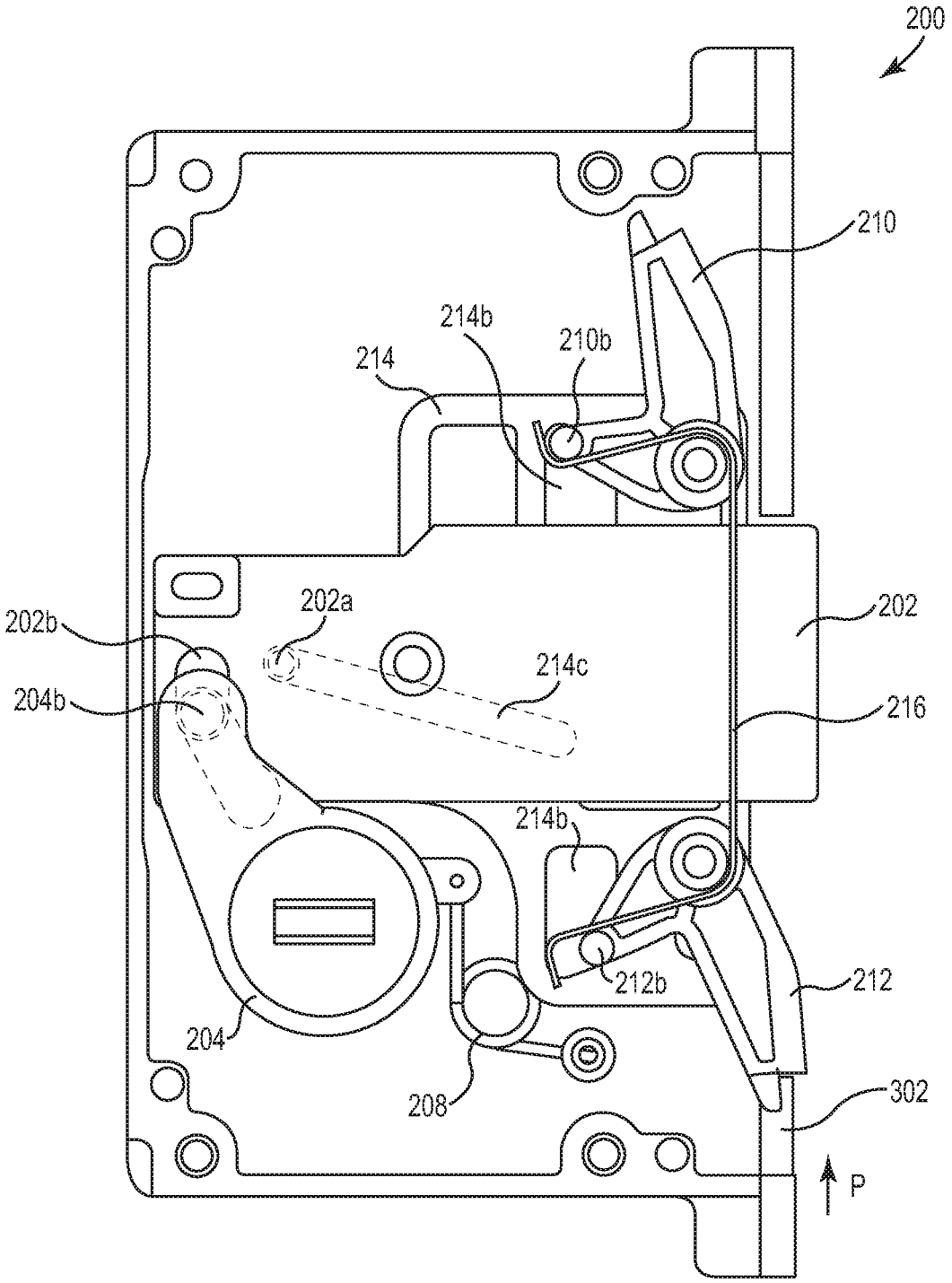
FIG. 5A-5C are opposite side views of the deadbolt assembly of FIG. 2, with a portion of the housing removed, in retracted, intermediate, and extended positions, respectively.
Figure 5B:
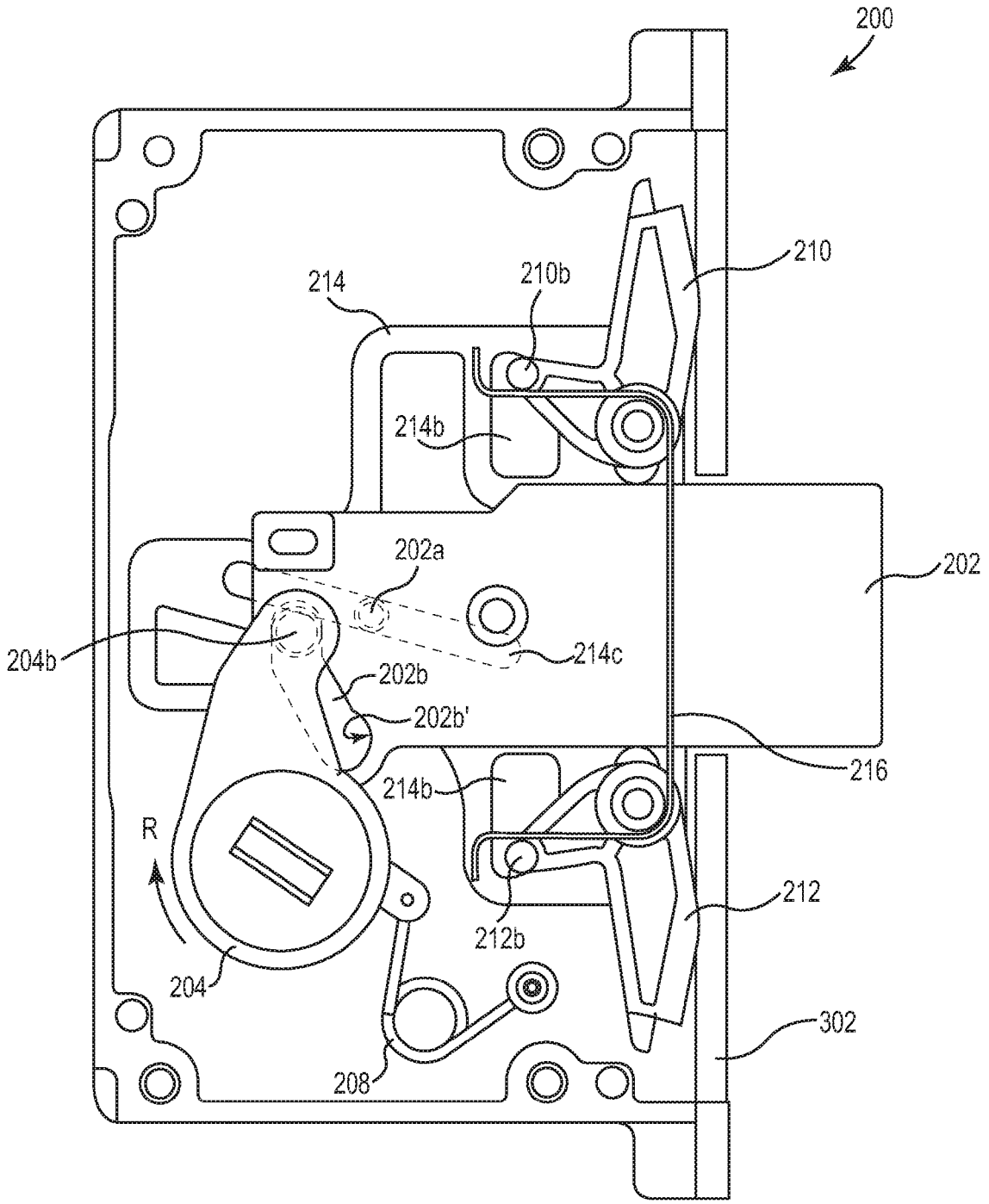
Figure 5C:
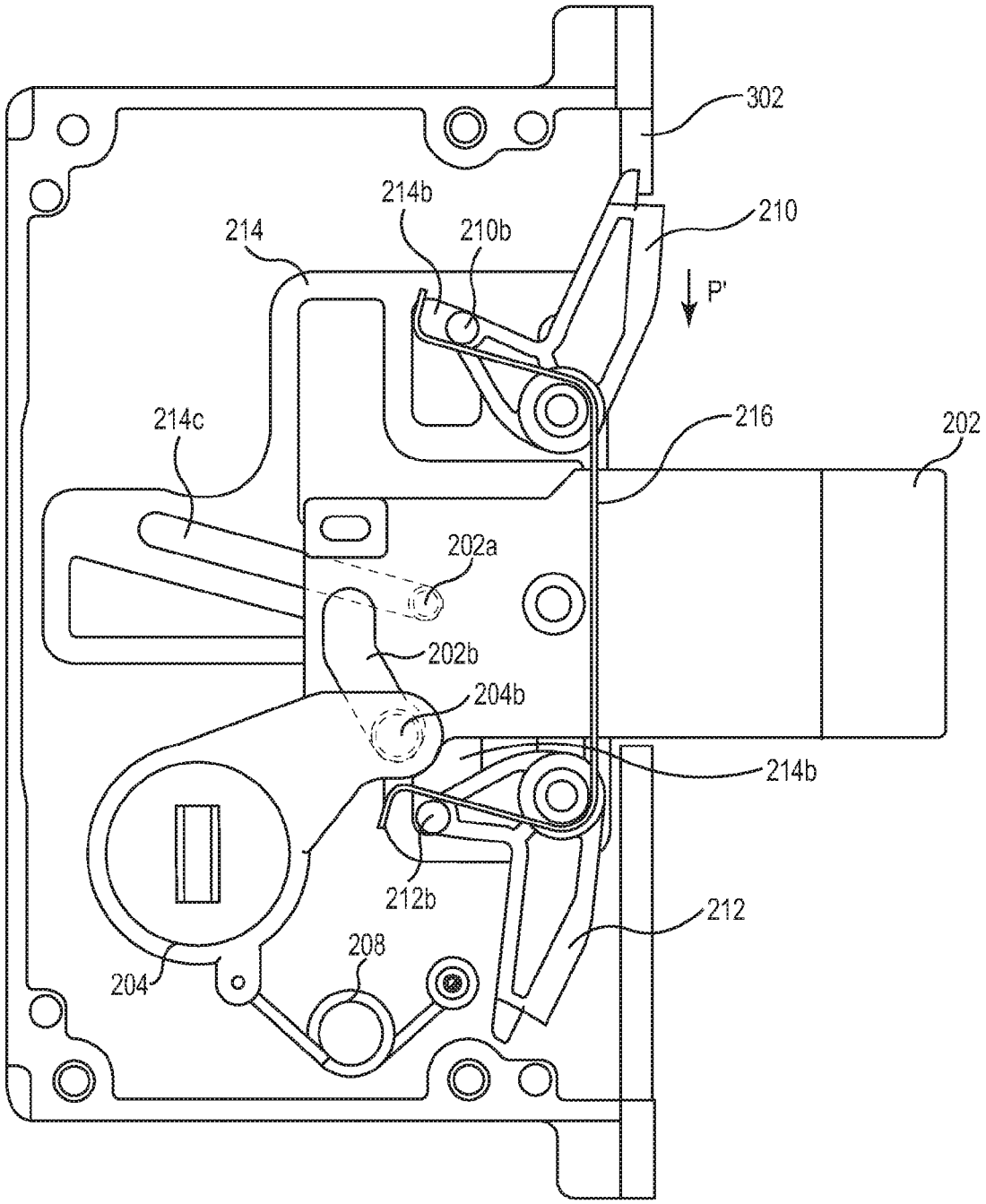

FIGS. 5A-5C depict partial opposite side views of the deadbolt assembly 200, in retracted, intermediate, and extended positions, respectively. The interaction of a number of elements of the deadbolt assembly, including the pawls 210, 212, the deadbolt 202, the pawl spring 216, etc., is described with regard to FIGS. 5A-5C. Additional elements are described above in FIGS. 3A-4B. In FIG. 5A, the deadbolt 202 is in the retracted position. The bias spring 208 forces the actuator 204 into a first position, where the deadbolt pin 204*b* is biased towards a rear upper portion of a deadbolt slot 202*b* on the deadbolt 202. In this position, the drive pin 202*a* is located near the top rear end of the elongate drive slot 214*c*, and the drive element 214 is in a first position. In this first position, in the depicted embodiment, the drive element 214 is located lower (relative to its second position, see FIG. 5C) in the deadbolt housing 200. In this lower position, the pawl spring 216 biases the lower pawl actuator pin 212*b* into a forward position in the lower opening 214*b*. This allows the lower pawl 212 to project into a blocking position, thus blocking the upward path of travel P of the shoot bolt 302. The upper pawl 210, however, cannot move into a blocking position because of the position of the drive element 214. When in the lower, first position, the drive element 214 forces the upper pawl actuator pin 210*b* into a rear portion of the upper opening 214*b*. This keeps the upper pawl 210 in the unblocking position. As described above, when the lower pawl 212 is in the blocking position, the shoot bolt 302 is prevented from moving from the unlocked to the locked position by the lower pawl 212. Accordingly, for an operator to move the shoot bolt 302 to the locked position to completely secure the door, the deadbolt 202 must first be extended. This process is described below in FIGS. 5B and 5C.

An intermediate position of the deadbolt 202 is depicted in FIG. 5B. Any deadbolt 202 position between retracted (FIG. 5A) and extended (FIG. 5C) is considered an intermediate position. In the intermediate position, the actuator 204 is being rotated R (in this figure, clockwise) by an operator, typically using a thumbturn on the interior side of the door, or by a key cylinder on the exterior side of the door. As the actuator 204 is rotated R, the deadbolt pin 204*b* moves within the deadbolt slot 202*b*, thus forcing the deadbolt 202 forward towards the fully extended position depicted in FIG. 5C. The bias spring 208 will force the actuator into the end of its range of rotation once the center point of the rotation R is reached. Although other types and numbers of springs may be used, this over-center bias spring 208 allows for a simple, secure means of ensuring the actuator 204 reaches the end of its rotation R and prevents efforts to defeat the MPL 100 by forcing the deadbolt 202 backwards.

As the deadbolt pin 204*b* moves the deadbolt 202 forward, the drive pin 202*a* moves forward within the elongate drive slot 214*c*. Since the elongate drive slot 214*c* is pitched within the drive element 214, the drive element 214 moves from its first, lower position towards its second, higher position. As this occurs, the shape of the lower opening 214*b* forces the lower pawl actuator pin 212*b* back within the lower opening 214*b*, thus moving the lower pawl 212 from the blocking position to the unblocking position. Conversely, as the drive element 214 moves towards its second, higher position, the pawl spring 216 biases the upper pawl actuator pin 210*b* towards a front of the upper opening 214*b*. This, in turn, moves the upper pawl 210 towards the blocking position. The upper pawl 210 will be in the ready position until the shoot bolt 302 is moved to the locking position after the deadbolt 202 is fully extended.

FIG. 5C depicts the deadbolt 202 in the fully extended position. In the fully extended position, the bias spring 208 forces the actuator 204 into its second end position. In the end position, the deadbolt pin 204*b* enters a detent 202*b*' (FIG. 5B) at the end of the deadbolt slot 202*b*. When the deadbolt 202 is in the fully extended position, the drive pin 202*a* reaches the bottom, forward end of the elongate drive slot 214*c*. When the drive pin 202*a* reaches this point, the drive element 214 reaches its second, higher position. In this position, the upper pawl actuator pin 210*b* is forced into the forward portion of the upper opening 214*b*, thus biasing the upper pawl 210 into the blocking position. Conversely, the lower pawl actuator pin 212*b* is forced towards a rear portion of the lower opening 214*b* by the shape of the opening 214*b*, thus moving the lower pawl 212 into the unblocking position. When the deadbolt 202 is fully extended and the upper pawl 210 biased towards the blocking position, the shoot bolt 302 may be moved to the locked position, as depicted, and the door may be completely locked. Further movement of the shoot bolt 302 along a downward path of travel P', from the locked position to the unlocked position, is prevented due to the blocking position of the upper pawl 210. In that case, to unlock the shoot bolts 302, the deadbolt 202 must first be moved back to the retracted position.

Figure 6:
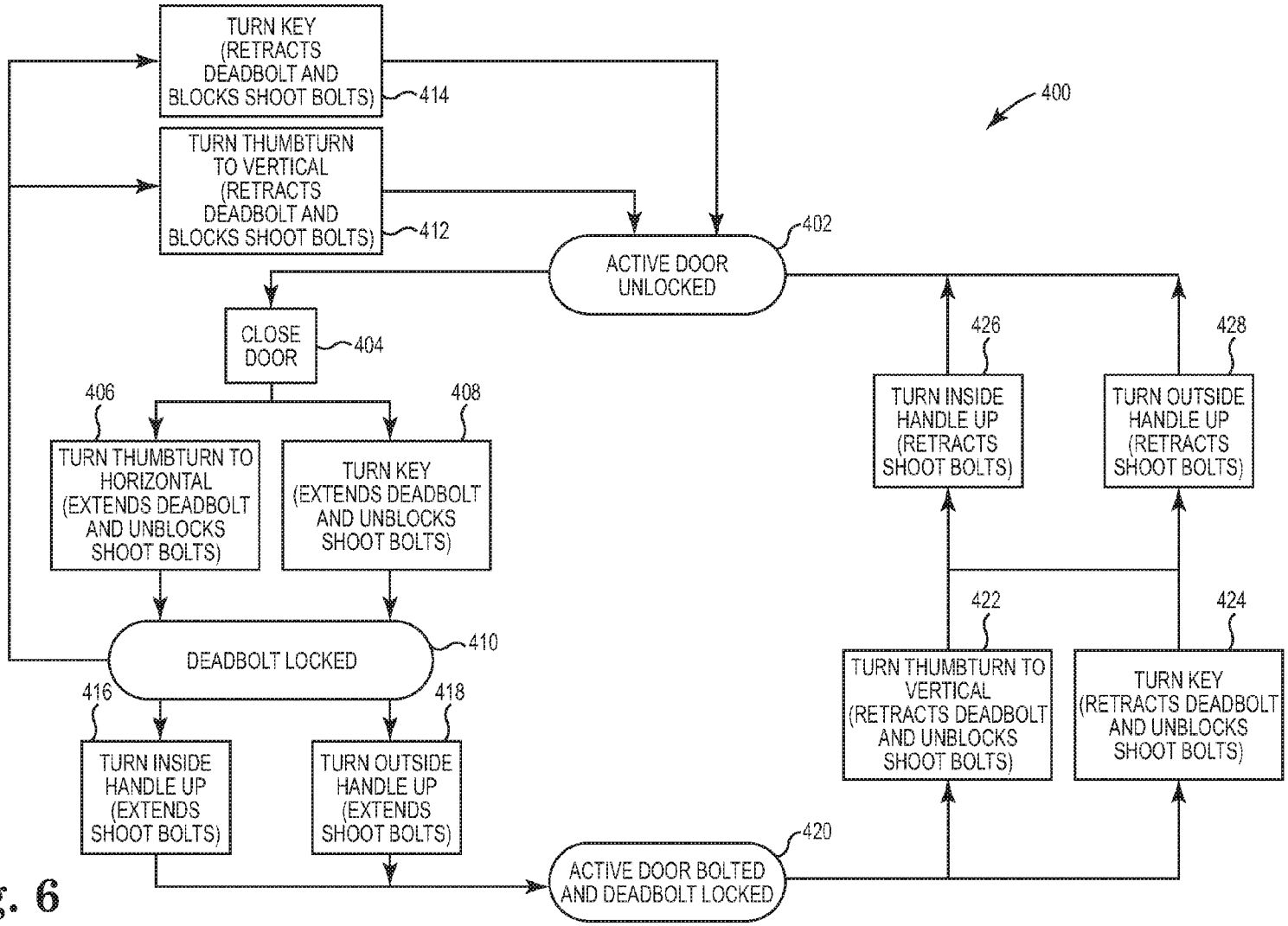
FIG. 6 depicts a method of locking a multi-point lock.

FIG. 6 depicts a method 400 of operating an MPL 100 that has been installed in a door. The method 400 contemplates an active, pivoting door that is initially in an unlocked condition (step 402). The door is first closed (step 404). The deadbolt may then be extended by turning a thumbturn on the interior side of the door (step 406) or a key on the exterior side of the door (step 408). Each of these two steps extends the deadbolt and also unblocks the shoot bolts. Upon actuation of the deadbolt in either step 406 or 408, the deadbolt is in a fully extended and locked condition (step 410), thus providing the door with a minimum level of security. To unlock the door at this point, the thumbturn may again be actuated (step 412) or the key may be used to unlock the door (step 414). Returning to the deadbolt locked condition (step 410), to fully lock the door (that is, to extend the shoot bolts), either of the inside handle (step 416) or the outside handle (step 418) may be rotated upwards. Which of the two handles is actuated will depend on whether the operator is located on the interior side or the exterior side of the door.

At this point, the door is in a completely bolted and deadbolt locked condition (step 420). Due to the configuration of the lock (for example, the blocking pawls described above), attempting to force down either the interior or exterior handle will not unlock any the locking elements. Accordingly, unlocking of the door can only be accomplished by first retracting the deadbolt. This may be accomplished by turning the thumbturn (step 422) or the key (step 424), thereby retracting the deadbolt and unblocking the shoot bolts. Thereafter, to completely unlock the door, the interior handle (step 426) or the exterior handle (step 428) is then turned down to retract the shoot bolts from the locked to the unlocked position. It should be noted that, in certain embodiments, turning either handle down will also retract the latch (FIG. 1, reference 304), thus allowing the door to be opened completely.

Multi-point locks such as those described herein have many advantages over existing locks. A number of advantages will be apparent from a review of the specification and figures. In addition, the versatility of the deadbolt assembly allows the MPL to be used with virtually any type of remote-actuated locking elements, in addition to the shoot bolts described. For example, the shoot bolts may be replaced with more complex remote-locking mechanisms, such as those described in U.S. Pat. No. 6,389,855, the disclosure of which is hereby incorporated by reference herein in its entirety. In such an embodiment, the pawls described herein may be used to prevent movement of the actuators of the remote-locking mechanisms. Additionally, either or both of the upper and lower pawls may be included in a particular multi-point lock, depending on the desired functionality. If only the lower pawl 212 is included, extension of the shoot bolts will be prevented unless the deadbolt is extended. If only the upper pawl is included, retraction of the shoot bolts will be prevented unless the deadbolt is first retracted. Accordingly, many locking options are possible. The latch assembly may be virtually any configuration. The latch assembly utilized may actuate both the latch and the shoot bolts or the shoot bolts alone. Additionally, only one shoot bolt (either upper or lower) may be utilized depending on the application. In that regard, it should be noted that the pawls in the deadbolt assembly contact a deadbolt opening in the upper shoot bolt only. However, due to the shoot bolt-actuation mechanism located within the latch assembly, blocking movement of the upper shoot bolt prevents movement of the lower shoot bolt.

The materials utilized in the manufacture of the MPL may be those typically utilized for lock manufacture, e.g., zinc, steel, brass, stainless steel, etc. Material selection for most of the components may be based on the proposed use of the MPL, level of security desired, etc. Appropriate materials may be selected for an MPL used on patio or entry doors, or on doors that have particular security requirements, as well as on MPLs subject to certain environmental conditions (e.g., moisture, corrosive atmospheres, etc.). For particularly light-weight door panels (for example, cabinet door panels, lockers, or other types of panels), molded plastic, such as PVC, polyethylene, etc., may be utilized for the various components. Nylon, acetal, Teflon®, or combinations thereof may be utilized for the latch to reduce friction, although other low-friction materials are contemplated.

The terms first, second, upper, lower, higher, top, bottom, panel, jamb, door, frame, etc., as used herein, are relative terms used for convenience of the reader and to differentiate various elements of the MPL from each other. In general, unless otherwise noted, the terms are not meant to define or otherwise restrict location of any particular element. For example, the MPL may be installed on one or both panels of a double-entry door. In such an embodiment, matching handles and thumbturns may be utilized. The thumbturns may drive deadbolts that are slightly off-alignment, allowing a deadbolt to extend from each door to the opposite door. Alternatively, the projecting length of one deadbolt may be reduced, such that the deadbolt from the MPL on the primary door extends into the deadbolt housing on the secondary door. In such a case, rotation of the thumbturn on the secondary door may move the drive element and pawls, thus allowing the shoot bolts in the secondary door to be extended, even though a functioning deadbolt is not present. In another embodiment, all or a portion of the MPL may be installed on a door jamb configured to look like a second door panel.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A lock comprising:

a deadbolt assembly disposed in a deadbolt assembly housing and comprising a deadbolt retractably disposed in the deadbolt assembly housing and a deadbolt actuator;

a latch assembly disposed in a latch assembly housing discrete from the deadbolt assembly housing, the latch assembly comprising a latch retractably disposed in the latch assembly housing, a shoot bolt, and a shoot bolt actuator, wherein the shoot bolt extends from the latch assembly housing and is slidably engaged with a portion of the deadbolt assembly housing; and a blocking element disposed in the deadbolt assembly housing and adapted to extend into a path of travel of the shoot bolt so as to block at least one of (a) actuation of the shoot bolt from a first position to a second position when the deadbolt is in a retracted position, and (b) actuation of the shoot bolt from a second position to a first position when the deadbolt is in an extended position.

2. The lock of claim 1, wherein the blocking element blocks actuation of the shoot bolt from the first position to the second position when the deadbolt is in the retracted position, and wherein the blocking element comprises a pawl, wherein when the deadbolt is in the retracted position, the pawl is in a blocking position that prevents movement of the shoot bolt from the first position to the second position.

3. The lock of claim 1, wherein the blocking element blocks actuation of the shoot bolt from the second position to the first position when the deadbolt is in the extended position, and wherein the blocking element comprises a pawl, wherein when the deadbolt is in the extended position, the pawl is in a blocking position that prevents movement of the shoot bolt from the second position to the first position.

4. The lock of claim 2, wherein the deadbolt assembly comprises a drive element engaged with the deadbolt and the pawl, wherein an extending movement of the deadbolt from the retracted position to the extended position causes a corresponding first movement of the drive element from a first drive element position to a second drive element position, such that the drive element moves the pawl from a blocking position to an unblocking position.

5. The lock of claim 3, wherein the deadbolt assembly comprises a drive element engaged with the deadbolt and the pawl, wherein a retracting movement of the deadbolt from the extended position to the retracted position causes a corresponding movement of the drive element from a second drive element position to a first drive element position, such that the drive element moves the pawl from a blocking position to an unblocking position.

6. The lock of claim 2, further comprising a spring element for biasing the pawl into the blocking position.

7. The lock of claim 3, further comprising a spring element for biasing the pawl into the blocking position.

8. The lock of claim 1, further comprising:

a thumbturn external to the deadbolt assembly, wherein the deadbolt actuator is adapted to engage with the thumbturn; and a handle external to the latch assembly, wherein the shoot bolt actuator is adapted to engage with the handle.

9. The lock of claim 1, further comprising a face plate, wherein the deadbolt housing is secured to the face plate at a first location and wherein the latch housing is secured to the face plate at a second location.

10. A lock comprising:

a deadbolt housing;

a deadbolt retractably disposed in the deadbolt housing;

a deadbolt actuator for actuating the deadbolt;

a shoot bolt selectively moveable between a second position and a first position, wherein the shoot bolt is actuated remote from the deadbolt housing, and wherein the shoot bolt is slidably engaged with a portion of the deadbolt housing;

a pawl located in the deadbolt housing, wherein the pawl is adapted to extend into a path of travel of the shoot bolt so as to block movement of the shoot bolt from at least one of (a) the first position to the second position, and (b) the second position to the first position;

a latch housing discrete from the deadbolt housing; and a latch assembly located within the latch housing, the latch assembly comprising a shoot bolt actuator for moving the shoot bolt from the second position to the first position.

11. The lock of claim 10, wherein the lock further comprises a thumb turn for actuating the deadbolt actuator.

12. The lock of claim 10, further comprising a handle for actuating the shoot bolt actuator.

13. The lock of claim 10, further comprising a pawl bias element for biasing the pawl into a blocking position.

14. The lock of claim 10, further comprising a deadbolt bias element for biasing the deadbolt into at least one of an extended position and a retracted position.

15. The lock of claim 10, further comprising a deadbolt bias element for biasing the deadbolt into both of an extended position and a retracted position.

* * * * *